US011104865B2

(12) United States Patent
Bandyopadhyay et al.

(10) Patent No.: US 11,104,865 B2
(45) Date of Patent: Aug. 31, 2021

(54) DISHWASH COMPOSITION COMPRISING RINSE-ACTIVATABLE ANTIFOAM

(71) Applicants: Punam Bandyopadhyay, Bangalore (IN); Maheshwara Shiva Naik, Bangalore (IN)

(72) Inventors: Punam Bandyopadhyay, Bangalore (IN); Maheshwara Shiva Naik, Bangalore (IN)

(73) Assignee: Conopeo, Inc., Englewood Cliffs, NJ (US)

( * ) Notice: Subject to any disclaimer, the term of this patent is extended or adjusted under 35 U.S.C. 154(b) by 574 days.

(21) Appl. No.: 15/998,838

(22) PCT Filed: Jan. 26, 2017

(86) PCT No.: PCT/EP2017/051601
§ 371 (c)(1),
(2) Date: Aug. 16, 2018

(87) PCT Pub. No.: WO2017/140472
PCT Pub. Date: Aug. 24, 2017

(65) Prior Publication Data

US 2021/0207061 A1 Jul. 8, 2021

(30) Foreign Application Priority Data

Feb. 17, 2016 (EP) ..... 16156137

(51) Int. Cl.

| | |
|---|---|
| ***C11D 1/83*** | (2006.01) |
| ***C11D 1/29*** | (2006.01) |
| ***C11D 1/90*** | (2006.01) |
| ***C11D 1/72*** | (2006.01) |
| ***C11D 1/831*** | (2006.01) |
| ***C11D 17/00*** | (2006.01) |
| ***C11D 3/00*** | (2006.01) |
| ***C11D 3/20*** | (2006.01) |
| ***C11D 11/00*** | (2006.01) |

(52) U.S. Cl.
CPC ..... *C11D 1/29* (2013.01); *C11D 1/72* (2013.01); *C11D 1/831* (2013.01); *C11D 1/90* (2013.01); *C11D 3/0026* (2013.01); *C11D 3/0047* (2013.01); *C11D 3/2079* (2013.01); *C11D 11/0035* (2013.01); *C11D 17/0008* (2013.01)

(58) Field of Classification Search
CPC ..... C11D 1/29; C11D 1/83
USPC ..... 510/424
See application file for complete search history.

(56) References Cited

U.S. PATENT DOCUMENTS

| | | | | |
|---|---|---|---|---|
| 3,919,111 | A | 11/1975 | Heyden | |
| 2004/0005991 | A1* | 1/2004 | Boucher | C11D 1/83 510/235 |
| 2006/0111266 | A1 | 5/2006 | Abera et al. | |
| 2014/0323386 | A1 | 10/2014 | Matsuzawa et al. | |
| 2015/0191676 | A1* | 7/2015 | Liu | C11D 10/042 510/340 |

FOREIGN PATENT DOCUMENTS

| | | |
|---|---|---|
| CA | 1201952 | 3/1986 |
| CN | 102533465 | 7/2012 |
| CN | 102965222 | 3/2013 |
| JP | 6172797 | 6/1994 |
| JP | 07138591 | 5/1995 |
| JP | 7138591 | 5/1995 |
| JP | 3284633 | 5/2002 |
| JP | 201412520 | 7/2014 |
| WO | WO9409108 | 4/1994 |
| WO | WO9727279 | 7/1997 |
| WO | WO9827189 | 6/1998 |
| WO | WO2006048091 | 5/2006 |
| WO | WO2013160265 | 10/2013 |
| WO | WO2015103736 | 7/2015 |
| WO | WO2016010501 | 1/2016 |
| WO | WO2016030226 | 3/2016 |

OTHER PUBLICATIONS

Search Report & Written Opinion in EP16156137; dated Sep. 8, 2016.
Search Report and Written Opinion in PCTEP2017051601; dated Apr. 10, 2017.
IPRP2 in PCTEP2017051601; dated Jan. 30, 2018.

* cited by examiner

*Primary Examiner* — Gregory E Webb
(74) *Attorney, Agent, or Firm* — Greenberg Traurig, LLP

(57) ABSTRACT

The invention is in the field of hard surface cleaning compositions. There is need for compositions that foam copiously during the washing/cleaning stage. However, during the rinse stage, the foam should rinse-off as quickly as possible in minimum number of rinses-cycles so that the process becomes sustainable. Disclosed is an aqueous cleaning composition, having a pH of 6.5 or lower, comprising (i) 3.0 to 25.0% by weight alkyl ethoxy sulphate; (ii) 1.0 to 5.0% by weight amphoteric surfactant; (iii) 0.1 to 1.0% by weight fatty acids being saturated non-hydroxy $C_{8-12}$ fatty acid and a saturated non-hydroxy $C_{14-18}$ fatty acid, where ratio of amount of said $C_{8-12}$ fatty acid to that of said $C_{14-18}$ fatty acid is from 1:0.1 to 1:10 parts by weight; and (iv) 0.5 to 5% by weight non-ionic surfactant, wherein (iii) and (iv) together an antifoaming system, and wherein amount of non-alkoxylated anionic surfactant in said composition in less than 1.0% by weight.

8 Claims, No Drawings

DISHWASH COMPOSITION COMPRISING RINSE-ACTIVATABLE ANTIFOAM

FIELD OF THE INVENTION

The present invention is in the field of hard surface cleaning compositions, more particularly dishwash compositions containing antifoaming agents, which get activated during the rinse cycle.

BACKGROUND OF THE INVENTION

Water is becoming increasingly scarce, especially in the developing countries. As a result, there is need to save water in as many ways as possible.

Foam is usually associated with cleaning products such as laundry detergent compositions and dishwash compositions. Products that foam copiously during the pre-rinse (cleaning) stage, or in other words, the ones, which have greater foaming ability, are perceived to be better than the ones that foam less. There is preference for products that foam copiously. On the other hand, it is also necessary to rinse the articles with clean water so that the foam subsides as quickly as possible. Most consumers tend to rinse until there is no visible sign of foam and usually four to five rinse-cycles is the norm. However, such a practice is not sustainable because substantial amount of fresh water is necessary for each rinse-cycle. Therefore there is need for compositions which foam copiously during pre-rinse stage, but which could be rinsed off with minimum amount of water.

Conventional antifoam agents like silicones and soap are good but they affect the foam during pre-rinse stage which is not desirable. Usually, at this stage, consumers want to see as much foam as possible.

WO9827189 A1 (COLGATE PALMOLIVE) discloses a mildly acidic laundry detergent composition containing rinse-activated antifoam ingredients. The composition has an anionic surfactant and/or at least one non-ionic surfactant. Also present is a rinse-activatable, pH sensitive foam control agent, which comprises a fatty acid. Upon rinsing, at least a portion of the fatty acid converts into soap to suppress the foam. The fatty acid may be saturated or unsaturated and preferably is lauric, myristic, oleic, stearic, palmitic or tallow fatty acid.

Even fatty acids are used as antifoam agents.

US2015/0191676 A1 (P&G) discloses a liquid laundry detergent composition containing an alkyl ethoxy sulphate surfactant along with two or more fatty acids as rinse-activatable antifoam characterized by specific distribution profile of the concerned fatty acids. The composition contains 0.1 wt % to 4 wt % of two or more fatty acids or salts where $C_{14}$ component forms 30% to 90% of the total fatty acid content.

WO 2016/030226 (Unilever) discloses a dishwash composition containing rinse-activated antifoaming system containing lauric acid and stearic acid.

U.S. Pat. No. 3,919,111 B1 (Henkel, 1975) discloses foam-control through mono or diester of hydroxystearyl alcohol with a saturated fatty acid or hydroxy fatty acid having from 15 to 24 carbon atoms dispersed in an organic solvent or water.

US2014/0323386 A1 (The Nisshin Oillio Group Ltd) discloses the use of polymerised hydroxyl stearic acid and an esterification reaction product of the polymer in detergent products for rinse-activated foam control.

While fatty acids are used for rinse benefits, i.e., in order to reduce the number of rinse-cycles; any indiscriminate increase in their amount is counterproductive. In particular, the use of fatty acids may render the compositions unstable and such compositions are prone to phase separation.

In WO2013160265 A1 (Henkel), hydroxyl fatty acids are used as foam stabilisers.

Therefore, there is an unmet need for compositions, which have more efficient rinse-activatable antifoaming system.

It is an object of the present invention to provide a cleaning composition, especially a dishwashing composition, which provides more foam during the washing or the pre-rinse stage but which requires lesser than the usual number of rinse-cycles for the foam to subside.

It has been determined that the object can be met by a composition in accordance with this invention.

SUMMARY OF THE INVENTION

In accordance with a first aspect is disclosed an aqueous cleaning composition, having a pH of 6.5 or lower, comprising:

(i) 3.0 to 25.0% by weight alkyl ethoxy sulphate;

(ii) 1.0 to 5.0% by weight amphoteric surfactant;

(iii) 0.1 to 1.0% by weight fatty acids being saturated non-hydroxy $C_{8-12}$ fatty acid and a saturated non-hydroxy $C_{14-18}$ fatty acid, where ratio of amount of said $C_{8-12}$ fatty acid to that of said $C_{14-18}$ fatty acid is from 1:0.1 to 1:10 parts by weight; and (iv) 0.5 to 5% by weight non-ionic surfactant, wherein (iii) and (iv) together form an antifoaming system, and wherein amount of non-alkoxylated anionic surfactant in said composition in less than 1.0% by weight.

These and other aspects, features and advantages of the invention will be apparent to those of ordinary skill in the art from a reading of the following detailed description and the appended claims.

DETAILED DESCRIPTION OF THE INVENTION

Compositions in accordance with this invention are aqueous. The term 'aqueous' implies that the compositions comprise 40 to 95% by weight water. It is preferred that the compositions comprise 50 to 90% by weight water and more preferably 70 to 85% by weight water, the balance being the essential and other optional ingredients of the invention.

Aqueous hard surface cleaning compositions invariably contain surfactants or surface-active agents. These may be anionic, non-ionic, cationic or zwitterionic. Surfactants are necessary to clean the articles which may be soiled dishes or kitchen ware. The total amount thereof may vary and it depends on the intended application as well the selling price of the product.

The compositions in accordance with this invention are generally suited for cleaning hard surfaces. The hard surface could be any household or industrial surface, but household surfaces are specifically considered and the invention is explained further with reference to this application, in particular, dish washing. Typical hard surfaces include glass, wood, tiles and other ceramic materials, metal surfaces, polished stones and polished concrete; more preferably stone or concrete kitchen tops, hobs, chimneys, platforms, sink, glass windows and cooker tops and tiles.

Dishwash compositions are available in various formats. These include powders, pastes, liquids and bars. Of all these formats, powders contain the least amount of surfactants while liquids contain the most.

The total surfactant content of a composition is expressed as the Active Detergent (AD) level. Powders are usually 2 to 4 AD products whereas dishwash or detergent liquids usually are 5 to 30 AD products.

In addition to surfactants, which determine the AD level, such compositions also contain other additives like foam boosters, foam suppressants (or antifoam agents), hydrotropes, polymers, colour and perfume.

Cleaning compositions like detergents and dishwash compositions usually contain a combination of surfactants where each surfactant has a definite purpose. The primary purpose of any surfactant is to act on soil/dirt on soiled articles.

Surfactants generate foam and the amount of foam or the foam volume varies according to type(s) of the surfactants present. Usually the anionic surfactants foam the most. Detergent and dishwash composition contain substantial amount of anionic surfactants. Therefore, such compositions tend to generate copious amount of foam during the washing stage at which the articles come in contact with the composition, either in neat form or the diluted form (i.e., diluted with water).

The volume of foam is usually associated with the efficacy of the product. Consumers prefer high-foaming products.

On the other hand, after the wash-cycle is over, the articles need water for rinsing. Generally, the articles are rinsed three to four times, and sometimes even up to six times. Each rinse cycle requires a fresh load of clean water.

It is known to include materials that reduce the formation of foam, either during the washing stage or during the rinse cycles. This allows the foam to subside as quickly as possible. In other words, the motive is to reduce the number of rinse-cycles.

Compositions in accordance with this invention provide high foam-volume during the washing or the pre-rinse stage but require lesser than the usual number of rinse-cycles for the foam to subside almost completely. The solution lies in use of a rinse-activatable antifoaming system comprising combination of fatty acids and non-ionic surfactant as defined in accordance with this invention.

Surfactants in the Composition for Basic Cleaning

Compositions in accordance with this invention comprise two different types of surfactants, which together may constitute a surfactant system meant for basic cleaning.

Alkyl Ethoxy Sulphate

The compositions contain in accordance with this invention comprise 3.0 to 25.0% by weight alkyl ethoxy sulphate. Such ethoxylated surfactants account for a significant amount of the total surfactant content. Therefore, they may be said to be primary surfactants.

The primary surfactant is a surfactant of the formula, $R_1—(OR')_n—O—SO_3^-M^+$, where, $R_1$ is saturated or unsaturated $C_8$-$C_{16}$, preferably $C_{12}$-$C_{14}$ alkyl chain; preferably, $R_1$ is a saturated $C_8$-$C_{16}$, more preferably a saturated $C_{12}$-$C_{14}$ alkyl chain; R' is ethylene; n is from 1 to 22. $M^+$ is a suitable cation, which provides charge neutrality, preferably sodium, calcium, potassium, or magnesium, more preferably a sodium cation.

Preferably the alkyl ethoxy sulphate contains 1 to 3 ethylene oxide units per molecule (n=1 to 3). In particular it is preferred that the alkyl ethoxy sulphate is sodium lauryl ether sulphate having 1 to 2 ethylene oxide units per molecule.

It is preferred that compositions in accordance with the invention comprise 8.0 to 18.0% by weight alkyl ethoxy sulphate.

Amphoteric Surfactant

The compositions in accordance with this invention also comprise 1.0 to 5.0% by weight amphoteric surfactant. Preferred amphoteric surfactants include cocoamidopropyl betaine (CAPB), coco amido propyl amine oxide (CAPAO), cocodiethanol amide (CDEA) and cocomonoethanol amide (CMEA). As the amphoteric surfactants constitute minor portion of the total surfactant content, it may be termed secondary surfactant. It is particularly preferred that the amphoteric surfactant is coco amido propyl betaine.

It is particularly preferred that ratio of the amount of amphoteric surfactant to that of alkyl ethoxy sulphate is 1:4 to 1:8 parts by weight. More particularly this ratio is 1:4 to 1:6 parts by weight. It is further preferred that the total amount of surfactant (AD) consisting of alkyl ethoxy sulphate and amphoteric surfactant is 8 to 25% by weight.

Combination of Fatty Acids as the Rinse Activatable Antifoam Agents

The compositions of the present invention comprise 0.1 to 1.0% by weight of a combination of fatty acids containing a saturated non-hydroxy $C_{8-12}$ fatty acid and a saturated non-hydroxy $C_{14-18}$ fatty acid, where ratio of amount of $C_{8-12}$ fatty acid to that of $C_{14-18}$ fatty acid is from 1:0.1 to 1:10 parts by weight. It is preferred that ratio of the amount of $C_{8-12}$ fatty acid to that of $C_{14-18}$ fatty acid is from 1:0.5 to 1:2 parts by weight.

It is particularly preferred that the compositions comprise 0.25 to 1.0% by weight of said fatty acids.

Said fatty acids are part of an antifoaming system together with non-ionic surfactant.

Without wishing to be bound by theory, it is believed that when $C_{8-12}$ and $C_{14-18}$ fatty acids are used in combination, the chain lengths of these fatty acids play a role on the flash foam and the antifoam activity during rinse. The $C_{8-12}$ component ensures there is no adverse effect on the flash (initial) foam while $C_{14-18}$ triggers the antifoam activity only during rinse. Individually, the fatty acids either destroy the initial foam or do not reduce the foam to a sufficient extent during rinse stage.

The fatty acids used in the present invention are saturated. Saturated lauric ($C_{12}$) and stearic acid ($C_{18}$) from each type are preferred.

It is preferred that the saturated non-hydroxy $C_{14-18}$ fatty acid is a single fatty acid. Alternatively, it could a mixture of two or more $C_{14-18}$ fatty acids. Hysteric acid is commercially available mixture and its composition is approximately 1:1 mixture of palmitic acid ($C_{16}$) and stearic acid ($C_{18}$). Such mixtures are preferred in view of their commercial availability.

Non-Ionic Surfactant

Compositions in accordance with this invention also include 0.5 to 5% by weight non-ionic surfactant which forms part of the antifoaming system. It is preferred that compositions in accordance with this invention comprise 0.5 to 3.0% by weight non-ionic surfactant.

Preferred nonionic surfactants include condensation products of a higher alcohol (e.g., an alkanol containing about 8 to 18 carbon atoms in a straight or branched chain configuration) with about 5 to 30 moles of ethylene oxide; for example lauryl or myristyl alcohol condensed with about 16 moles of ethylene oxide (EO). Particularly preferred is Lauryl alcohol condensed with 5, 7 or 9 moles of ethylene oxide (Laureth 5, Laureth 7 and Laureth 9). Condensates of 2 to 30 moles of ethylene oxide with sorbitan mono- and tri $C_{10}$-$C_{20}$ alkanoic acid esters having HLB of 8 to 15 also may be used as nonionic surfactant. These surfactants are well known and are available under the Tween® trade name. Suitable surfactants include polyoxyethylene (4) sorbitan monolaurate, polyoxyethylene (4) sorbitan monostearate, polyoxyethylene (20) sorbitan trioleate and polyoxyethylene (20) sorbitan tristearate.

The term 'non-soap anionic surfactants' is known to persons who are skilled in the art of detergent manufacture. Soaps are salts, usually sodium salts, of fatty acids and they constitute a class of anionic surfactants. Soaps are prepared by neutralisation of fatty acids with an alkali or by transesterification of oils, generally vegetable oils.

The amount of non-alkoxylated anionic surfactant in said composition in less than 1.0% by weight. Such surfactants include alkylbenzene sulphonates, alpha olefin sulphonates, ester sulphonates and primary non-ethoxylated alkyl sulphates.

The pH of the Composition

The pH of the compositions in accordance with this invention is 6.5 or lower, like e.g. from 2 to 6.5, preferably 4.5 to 6.5, more preferably 5 to 6.5 and most preferably 5.5 to 6.

Foaming Ability of the Compositions

The foaming ability of the compositions in accordance with the invention could be determined by any suitable method known in the art.

The Cylinder Shake method is usually most suited for such applications. This procedure is utilized to determine foamability and how quickly the foam subsides.

A fixed amount of the composition (diluted with water) is poured into a graduated cylinder. A stopper is applied. The cylinder is inverted a number of times and then the foam volume is determined in ml.

Preferably, the foam volume is determined as follows:

A test solution of the concerned composition (6.25 g/1) is prepared using 24 F.H. [French Hardness] water at 40° C. Fifty ml of this solution is transferred to a 250 ml graduated glass cylinder. The solution is shaken by first covering the cylinder with its lid and by inverting the cylinder ten times. Then it is placed on the flat surface for one minute to allow the layers to separate. Thereafter, the solution is shaken one more time to allow the foam to even out.

The foam volume is recorded after excluding the amount of aliquot water as the initial foam (washing/pre-rinse stage).

To measure the foam at the end of each rinse cycle, the aliquot water is decanted along the sides of the cylinder while allowing the foam to be retained therein. Fifty ml of fresh 40° C. 24 F.H. water is added along the sides of the cylinder. The solution is shaken and the foam volume is measured again as described earlier. The rinse-cycle is repeated until the foam subsides.

The initial foam volume of a control composition i.e., composition devoid of fatty acids, is taken to be the standard or desired volume.

The initial foam is measured in the case of each experimental composition and is compared against the foam volume of the control composition. While a difference of 20 units in the volume is acceptable, any greater difference is not.

Accordingly in a preferred aspect of the invention is disclosed an aqueous cleaning composition, having a pH of 6.5 or lower, comprising:

(i) 3.0 to 25.0% by weight alkyl ethoxy sulphate;
(ii) 1.0 to 5.0% by weight amphoteric surfactant;
(iii) 0.1 to 1.0% by weight fatty acids being saturated non-hydroxy $C_{8-12}$ fatty acid and a saturated non-hydroxy $C_{14-18}$ fatty acid, where ratio of amount of said $C_{8-12}$ fatty acid to that of said $C_{14-18}$ fatty acid is from 1:0.1 to 1:10 parts by weight; and
(iv) 0.5 to 5% by weight non-ionic surfactant, wherein (iii) and (iv) together form an antifoaming system, and wherein amount of non-alkoxylated anionic surfactant in said composition is less than 1.0% by weight and wherein foam volume of said composition during pre-rinse stage as determined by Cylinder Shake method described herein, is at least 140 ml and said foam volume subsides to 20 ml or less that that within four rinse-cycles.

Optional Ingredients

In addition to the ingredients described earlier, the compositions in accordance with the invention may comprise other known ingredients such as thickeners, colorants, preservatives, polymers, anti microbial agents, perfumes, pH adjusters, sequesterants, alkalinity agents and hydrotropes.

Use and Method

The method of cleaning any hard surface such as soiled dishes using the compositions of the invention is not different from the usual method. In particular, such a method includes a step of contacting a soiled article, such as a plate, with an efficacious amount of the composition of the invention; preferably with the help of a scrubber or implement such as sponge. It is followed by scouring the article with a pad or cloth;

followed by scrubbing it and later by rinsing with water until foam subsides to 20 ml or less than that within four rinse-cycles.

Accordingly, in another aspect of the invention, is disclosed a sustainable method of cleaning a hard surfaces comprising the steps of:

(i) applying thereto a neat or diluted form of a composition according to the first aspect;
(ii) cleaning said surface with an implement; and
(iii) rinsing said surface with water.

While the aqueous cleaning compositions according to the invention are generally suitable for use in dish wash applications for manual or machine assisted cleaning, the compositions could also be used for related applications like fabric cleaning and general hard surface cleaning.

The invention will be explained with the help of the following non-limiting examples.

EXAMPLES

Two different dishwash compositions containing just basic minimum ingredients (therefore termed herein as base compositions BC1 and BC2) were prepared. The compositions were prepared because they represent widely used dishwash compositions. The formulations are included in Table 1.

TABLE 1

Table 1: Formulations of Base Composition BC1

| Ingredient | BC1 % by weight | BC2 % by weight |
|---|---|---|
| Sodium Lauryl ether sulphate 1EO (on 100% active basis) | 9.0 | 18.0 |
| Coco Amido Propyl Betaine (On 100% active basis) | 1.5 | 3.0 |
| Water and other minors | to 100 | to 100 |
| pH | 5.5 | 5.5 |
| Total Active Detergent level (AD) | 10.5 | 21.0 |

For the purpose of experiments on foamability, varying levels of saturated non-hydroxy fatty acid and non-ionic surfactant were added to each of the base compositions.

Details are shown in Tables 2 and 3. All the formulations were subjected to foam volume tests.

All observations pertaining to the experiments on Base Composition 1 are summarised in Tables 2, 3 and 5. All observations pertaining to the experiments on Base Composition 2 are summarised in Table 6.

Note: In all the tables that follow, PR means foam volume at pre-rinse stage

Example 1: Synergistic Effect of the Claimed Ingredients

TABLE 2

| Example no. | Details of the formulation | PR 0 | Foam volume at rinse-cycle 1 | 2 | 3 | 4 |
|---|---|---|---|---|---|---|
| 1 | BC1 | 135 | 135 | 135 | 110 | 80 |
| 2 | BC1 containing 0.5 wt % $C_{12-18}$ EO7 | 130 | 130 | 120 | 90 | 60 |
| 3 | BC1 containing 0.25 wt % Lauric acid and 0.25 wt % Stearic acid | 130 | 130 | 110 | 75 | 40 |
| 4 | BC1 containing 0.25 wt % Lauric acid and 0.25 wt % Stearic acid and 0.5 wt % $C_{12-18}$ EO7 | 140 | 120 | 90 | 50 | 10 |

The data presented in table 1 indicates that the base composition retains its tendency to foam substantially even after four rinses. Inclusion of non-ionic surfactant does not improve the situation but it does not adversely affect the initial foam either (Example 2).

Addition of fatty acids reduces the amount of foam (at the end of rinse 4) to 40 ml but that is also not good enough reduction. On the other hand, the composition in accordance with the invention (Example 4) has substantially reduced tendency to foam after four rinses.

Example 2: Effect of % by Weight of the Non-Ionic Surfactant

The compositions and the observations are shown in Table 3.

TABLE 3

| Example no. | Details of formulations | PR 0 | Foam volume at rinse-cycle 1 | 2 | 3 | 4 | 5 |
|---|---|---|---|---|---|---|---|
| 5 | BC1 containing 0.25 wt % Lauric acid and 0.25 wt % Stearic acid and 0.5 wt % $C_{12-18}$ EO7 | 130 | 115 | 90 | 50 | 20 | — |
| 6 | BC1 containing 0.25 wt % Lauric acid and 0.25 wt % Stearic acid and 1.0 wt % $C_{12-18}$ EO7 | 130 | 110 | 80 | 50 | 18 | — |
| 7 | BC1 containing 0.25 wt % Lauric acid and 0.25 wt % Stearic acid and 2.0 wt % $C_{12-18}$ EO7 | 130 | 110 | 80 | 40 | 10 | — |
| 8 | BC1 containing 0.25 wt % Lauric acid and 0.25 wt % Stearic acid and 3.0 wt % $C_{12-18}$ EO7 | 130 | 120 | 90 | 50 | 10 | — |
| 9 | BC1 containing 0.25 wt % Lauric acid and 0.25 wt % Stearic acid and 4.0 wt % $C_{12-18}$ EO7 | 120 | 120 | 100 | 60 | 20 | — |
| 10 | BC1 containing 0.25 wt % Lauric acid and 0.25 wt % Stearic acid and 5.0 wt % $C_{12-18}$ EO7 | 120 | 110 | 90 | 50 | 20 | — |
| 11 | BC1 containing 0.25 wt % Lauric acid and 0.25 wt % Stearic acid and 6.0 wt % $C_{12-18}$ EO7 | 120 | 110 | 100 | 70 | 30 | 14 |

TABLE 3-continued

| Example no. | Details of formulations | PR 0 | Foam volume at rinse-cycle 1 | 2 | 3 | 4 | 5 |
|---|---|---|---|---|---|---|---|
| 12 | BC1 containing 0.25 wt % Lauric acid and 0.25 wt % Stearic acid and 7.0 wt % $C_{12-18}$ EO7 | 120 | 100 | 70 | 50 | 40 | 12 |
| 13 | BC1 containing 0.25 wt % Lauric acid and 0.25 wt % Stearic acid and 10.0 wt % $C_{12-18}$ EO7 | 100 | 100 | 80 | 50 | 30 | 10 |
| 14 | BC1 containing 0.25 wt % Lauric acid and 0.25 wt % Stearic acid and 20.0 wt % $C_{12-18}$ EO7 | 110 | 110 | 100 | 70 | 40 | 12 |

The data in Table 3 indicates that even as high as 3 wt % non-ionic surfactant could be safely included without loss of performance.

It is noted that examples 4 and 5 concern the same composition showing the same trend in foam volume decrease and required number of rinses.

Example 3: Effect of Unsaturation

In this experiment, an unsaturated fatty acid was included instead of the saturated fatty acids. Details of the formulation and the observations are shown in Table 4.

TABLE 4

| Example no. | Details of the formulation | PR 0 | Foam volume at rinse-cycle 1 | 2 | 3 | 4 |
|---|---|---|---|---|---|---|
| 15 | BC1 containing 0.5 wt % oleic acid and 0.5 wt % $C_{12-18}$ EO7 | 100 | 100 | 80 | 40 | 12 |

The data in Table 4 indicates that although the composition has reduced tendency to foam at the end of four rinses, there is substantial reduction in the amount of initial foam, making such fatty acids unsuitable for the purpose.

Example 4: Effect of % by Weight of Saturated Fatty Acids

In this experiment, compositions with differing amount of saturated fatty acids were prepared, keeping the amount of non-ionic surfactant constant across all formulations. Details are summarised in Table 5.

TABLE 5

| Example no. | Details of the formulation | PR 0 | Foam volume at rinse-cycle 1 | 2 | 3 | 4 |
|---|---|---|---|---|---|---|
| 16 | BC1 containing 0.25 wt % Lauric acid and 0.25 wt % Stearic acid and 0.5 wt % $C_{12-18}$ EO7 | 140 | 140 | 110 | 60 | 20 |
| 17 | BC1 containing 0.5 wt % Lauric acid and 0.5 wt % Stearic acid and 0.5 wt % $C_{12-18}$ EO7 | 130 | 110 | 80 | 40 | 8 |
| 18 | BC1 containing 1.0 wt % Lauric acid and 1.0 wt % Stearic acid and 0.5 wt % $C_{12-18}$ EO7 | 110 | 100 | 70 | 30 | 10 |

The intended technical effects can be obtained so long as the total amount of fatty acids is up to 1% by weight. An increase affects the initial foam (Example 18).

Example 4: Experiments Conducted on Base Composition 2

The details are summarised in Table 6.

TABLE 6

| Example no. | Details of the formulation | PR 0 | Foam volume at rinse-cycle 1 | 2 | 3 | 4 |
|---|---|---|---|---|---|---|
| 19 | BC2 | 140 | 150 | 140 | 80 | 40 |
| 20 | BC2 + 0.25 wt % Lauric acid + 0.25 wt % Stearic acid + 0.5 wt % $C_{12-18}$ EO7 | 130 | 120 | 66 | 20 | 4 |
| 21 | BC2 + 0.5 wt % Lauric acid + 0.5 wt % Stearic acid + 1 wt % $C_{12-18}$ EO7 | 125 | 90 | 35 | 4 | |
| 22 | BC2 + 0.75 wt % Lauric acid + 0.75 wt % Stearic acid + 1.5 wt % $C_{12-18}$ EO7 | 70 | 30 | 4 | | |

This base composition per-se foams substantially, as is the case with the other base composition. Addition of 0.5% by weight fatty acids (total) provides the desired technical effect. An increase up to 1% by weight also provides the intended technical effects. However, more amount affects the initial foam (Example 22).

The disclosed examples meet the need for compositions which have more efficient rinse-activatable antifoaming system.

The disclosed examples provide a cleaning composition, especially a dishwashing composition, which provides more foam during the washing or the pre-rinse stage but which requires lesser than the usual number of rinse-cycles for the foam to subside.

The invention claimed is:

1. An aqueous cleaning composition, having a pH of 6.5 or lower, comprising:

(i) 3.0 to 25.0% by weight alkyl ethoxy sulphate;

(ii) 1.0 to 5.0% by weight amphoteric surfactant;

(iii) 0.1 to 1.0% by weight fatty acids being saturated non-hydroxy $C_{8-12}$ fatty acid and a saturated non-hydroxy $C_{14-18}$ fatty acid, where ratio of amount of said $C_{8-12}$ fatty acid to that of said $C_{14-18}$ fatty acid is from 1:0.1 to 1:10 parts by weight; and (iv) 0.5 to 5% by weight non-ionic surfactant, wherein (iii) and (iv) together form an antifoaming system, and wherein amount of non-alkoxylated anionic surfactant in said composition in less than 1.0% by weight.

2. A composition as claimed in claim 1 wherein ratio of the amount of said amphoteric surfactant to that of said alkyl ethoxy sulphate is 1:4 to 1:8 parts by weight.

3. A composition as claimed in claim 1 comprising 0.25 to 1.0% by weight of said fatty acids.

4. A composition as claimed in claim 1 wherein ratio of amount of said $C_{8-12}$ fatty acid to that of said $C_{14-18}$ fatty acid is from 1:0.5 to 1:2 parts by weight.

5. A composition according as claimed in claim 1 wherein said composition comprises 0.5 to 3.0% by weight non-ionic surfactant.

6. A composition as claimed in claim 1 wherein said alkyl ethoxy sulphate contains 1 to 3 ethylene oxide units per molecule.

7. A composition as claimed in claim 1, wherein said amphoteric surfactant is coco amido propyl betaine.

8. A method of cleaning a hard surface, comprising the steps of:

(v) applying thereto a neat or diluted form of a composition according to claim 1;

(vi) cleaning said surface with an implement; and (vii) rinsing said surface with water.

* * * * *